US005354121A

United States Patent [19]

Allum

[11] Patent Number: 5,354,121

[45] Date of Patent: Oct. 11, 1994

[54] SUPPORT AND RESTRAINT DEVICE FOR SMALL CHILD

[76] Inventor: Rita J. Allum, 1413 Bourcier Drive, Orleans, Ontario, Canada, K1E 3K9

[21] Appl. No.: 19,428

[22] Filed: Feb. 18, 1993

[51] Int. Cl.[5] ..... A47D 15/00; A62B 35/00

[52] U.S. Cl. ..... 297/485; 297/488

[58] Field of Search ..... 297/219.1, 219.12, 229, 297/230.1, 181, 230.12, 482, 485, 488

[56] References Cited

U.S. PATENT DOCUMENTS

| | | | |
|---|---|---|---|
| 3,054,637 | 9/1962 | Pambello | 297/4 |
| 3,093,407 | 6/1963 | Wilson | 297/4 |
| 3,222,694 | 12/1965 | Schick | 297/219.1 X |
| 4,324,430 | 4/1982 | Dimas, Jr. et al. | 297/250 |
| 4,759,588 | 7/1988 | Husnik | 297/468 |
| 4,834,460 | 5/1989 | Herwig | 297/485 |
| 4,864,668 | 9/1989 | Crisp | 297/229 X |
| 5,016,915 | 5/1991 | Perry | 297/482 X |
| 5,123,699 | 6/1992 | Warburton | 297/485 X |
| 5,137,335 | 8/1992 | Marten | 297/485 |

FOREIGN PATENT DOCUMENTS

| | | |
|---|---|---|
| 505888 | 9/1954 | Canada . |
| 631071 | 11/1961 | Canada . |
| 663786 | 5/1963 | Canada . |
| 1256010 | 6/1989 | Canada . |

*Primary Examiner*—Peter R. Brown

*Attorney, Agent, or Firm*—Antonelli, Terry, Stout & Kraus

[57] ABSTRACT

A support and restraint device for a small child for use on a shopping cart, umbrella stroller or a conventional chair. The device comprises a body member including a seat portion and a back portion, the two portions being hinged together. The back portion has a wide belt with two parts which wrap around the child and the back portion is secured to a chair back or other vertical support, e.g. with belts which may be attached to the back portion. The belt is padded with high density foam material which is sufficiently stiff to help support a small child in an upright position. The back and seat portions are also padded, preferably also with high density foam material. The padding material is retained in pockets and can be removed so that the device can be laundered.

17 Claims, 2 Drawing Sheets

SUPPORT AND RESTRAINT DEVICE FOR SMALL CHILD

BACKGROUND OF THE INVENTION

This invention relates to a support and restraint device for a small child and in particular a device which can comfortably but securely hold a small child in a shopping cart, umbrella stroller or chair. By "small child" is meant primarily infants and toddlers from about 4 months to 18 months of age.

A variety of carriers and harnesses have been developed to support and secure an infant to a seat or chair or the like. However, such carriers are often constructed with a rigid frame, making them inconvenient to store or transport and relatively expensive to fabricate. One such carrier is disclosed in U.S. Pat. No. 4,324,430, issued Apr. 13, 1982, which uses a frame which can be formed of metal tubing.

U.S. Pat. No. 4,759,588, issued Jul. 26, 1988, discloses a padded seat cushion for use in an automobile. Padded arms disguise the seat belt which secures the child in place.

Canadian Patent No. 505,888 issued Sep. 21, 1954 discloses a harness which can be put on a small child and then secured about the seat and back of a chair.

Canadian Patent No. 1,256,010 issued Jun. 20, 1989 discloses a somewhat complicated combination infant bed and toddler seat for shopping carts.

Canadian Patent No. 663,786 issued May 28, 1983 discloses a child restraining harness comprising a length of canvas material which, in use, is folded over the back of a chair, after which a number of cords on each side are tied together to form a pocket which fits around the back of the chair. A tongue portion is then brought up between the legs of the child and secured by a strap having two ends secured together behind the chair.

A child restraint device is available in the retail market under the trade-mark "Buggy Hugger". It is manufactured by Formelco Limited of Mississauga, Ontario, Canada. It comprises a generally rectangular cloth pad filled with polyester fibre, a cloth loop sewn to the bottom edge of the pad, and a cloth belt. In use, the pad is placed on a chair (or other support) so that part of the pad is on the seat of the chair and part rests against the back of the chair. The loop is then passed up between the child's legs, after which the belt is inserted through the loop and secured around the back of the chair with a Velcro fastener. Note that to secure the belt, one must reach around behind the child or possibly go behind the child. This can be awkward and, in the case of an active toddler, possibly a bit risky in that the child might fling herself forward before the ends of the belt are secured together. The device, being formed of cloth with fibre padding, is very supple and is incapable of helping to support an infant or toddler in an upright position on the chair.

SUMMARY OF THE INVENTION

It is an object of the present invention to provide a support and restraint device for a small child for use on a shopping cart, umbrella stroller, chair or other seating object. The device is of simple construction and light weight and has no rigid frame. It requires little storage space and can be easily laundered after removal of a few pads of solid foam material.

According to a broad aspect of the invention there is provided a support and restraint device for a small child comprising a body member including a back portion, a seat portion and hinge means joining said back portion and said seat portion, a wide belt having first and second arm portions attached to said back portion, said arm portions being provided with means for releasably securing them together, said seat portion, said back portion and said first and second arm portions comprising cloth covered padding material, said arm portions having padding formed of blocks of high density foam material having sufficient stiffness that said arm portions, when secured together around a small child's upper body, help to hold said child in an upright seated position on said seat portion when said back portion is secured in a substantially vertical position.

The arms of the wide belt overlap when accommodating a small infant within the support and restraint device. Their width covers a large portion of the infant's abdomen and chest area, and when tightly secured together provide significant support to the child. The length of the wide belt is adjustable to accommodate children of varying sizes: the larger the child, the smaller the degree of overlap in the arms.

DESCRIPTION OF THE PREFERRED EMBODIMENT

Figure 1:
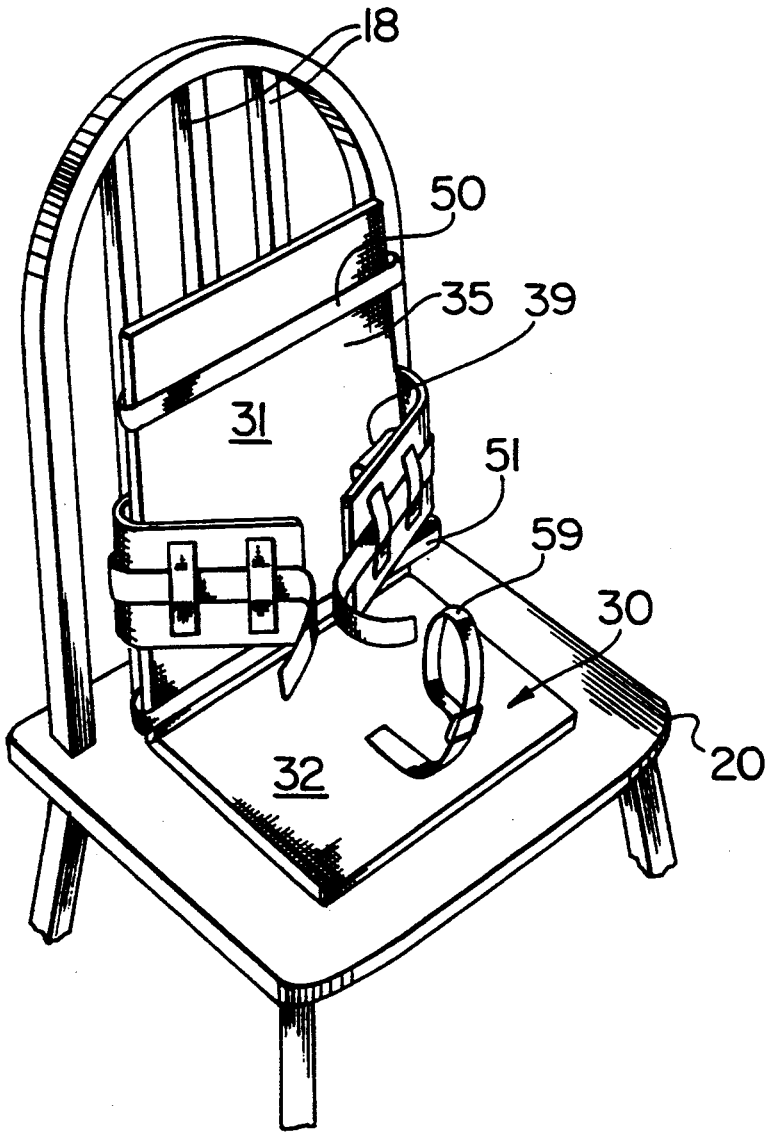
FIG. 1 is a pictorial illustration of a child support and restraint device according to the invention as used on a chair.
Figure 2:
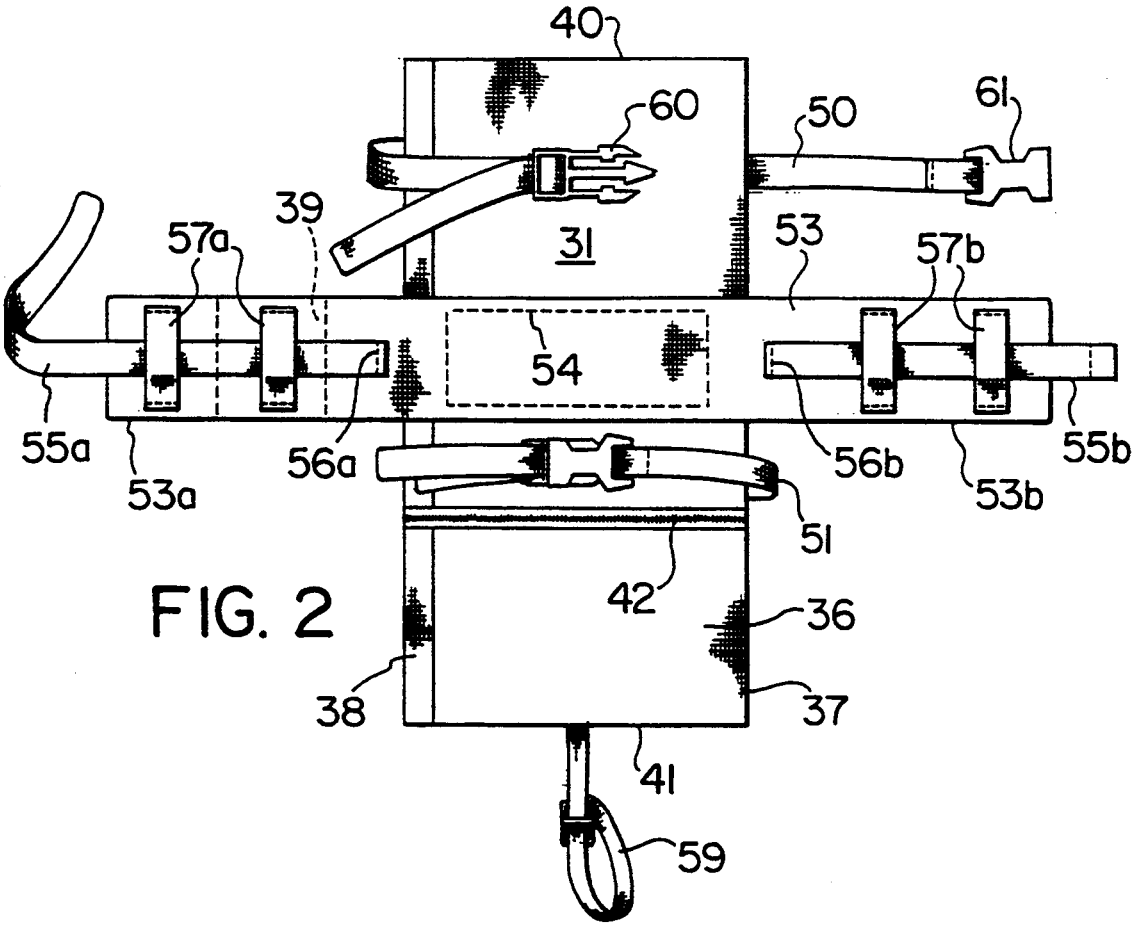
FIG. 2 is a rear view of the device.
Figure 3:
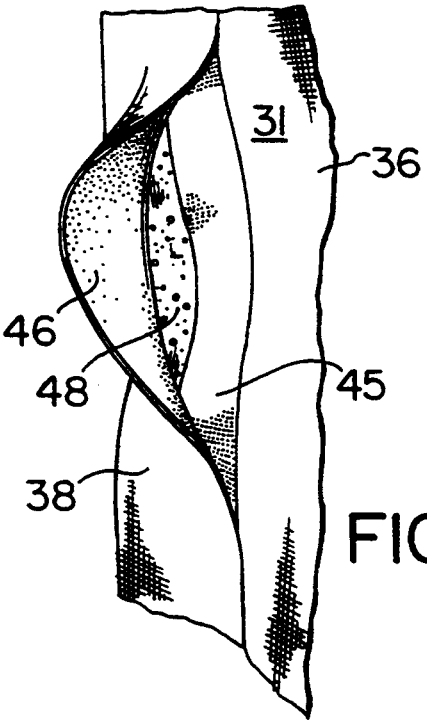
FIG. 3 is a detail view of part of the back portion of the device.

FIG. 1, not to scale, pictorially illustrates a small child support and restraint device according to the present invention. It is shown secured to a chair 20 as it appears before a child has been secured in place. The device, generally indicated at 30, comprises a main or body member including a first or back portion 31 and a second or seat portion 32. The body member 30 is formed of a rectangular piece of soft but strong cloth such as one comprising a blend of cotton and polyester folded longitudinally to provide a front side 35 and a back side 36 (FIG. 3). Referring to FIG. 2, the cloth is folded along a line 37 which is off-set from the longitudinal centre line of the cloth so that a narrow strip 38 of cloth from the front side can be folded back over a longitudinal edge region of the back side 36. The two sides are sewn together at the ends 40 and 41 and along a line 42. The stitches along line 42 separate the body member into a first (back) portion 31 and a second (seat) portion 32, both of which comprise pockets for receiving padding material, preferably blocks of high density foam material. Both pockets are closed by the strip of cloth 38. The line of stitches 42 functions as a hinge so that when the restraint is placed on a chair it readily assumes an L-shape with seat portion 32 flat on the seat of the chair and the back portion 31 against the rungs 18 of the chair. For storage or transportation, the seat portion 32 can be folded back against the back portion 31.

Figure 4:
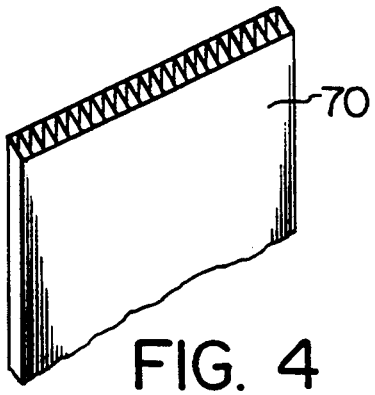
FIG. 4 is a pictorial illustration of a sheet of polyflute.

The use of high density foam as filler padding affords back portion 31 both vertical rigidity facilitating upright support of an infant and transverse flexibility for contouring back portion 31 to more comfortably hug the infant as well as easily adapting to the configuration of the seating item. In a variant embodiment, a sheet of polyflute plastic (i.e. extruded polyethylene fluted sheet 70, FIG. 4) is used in conjunction with the high density foam. The polyflute sheet is slightly shorter and narrower, by approximately one-half inch, than the pad of high density foam, and placed within back portion 31 between the foam pad and the cloth covering of back side 36 (FIG. 3), orientated so that its flutes extend longitudinally with respect to back portion 31. This combination provides further rigidity along the length of back portion 31 while still permitting flexibility along its width.

FIG. 3 is a detail drawing of the upper left corner region of the back portion 31 of the child support and restraint device as viewed in FIG. 2. In FIG. 3, a part of the strip of cloth 38 has been pulled back to show a VELCRO fastener to hold the strip closed against the back 36 of the upper body portion 31. One part 45 of the VELCRO fastener is sewn to the back side 36 while the other part 46 of the VELCRO fastener is sewn to the inner side of the strip 38 of cloth. Also visible, at 48, is part of a block of foam padding material in the pocket of the back portion 31.

Referring back to FIG. 2, the bottom portion 36 may not require a VELCRO fastener to close the pocket holding the bottom block of foam padding material; however, it can be provided if desired. By pulling back the strip 38, the blocks of foam padding material can be removed so that the cloth covering can be laundered.

The back portion 31 is, when the device is in use, secured to the back of a chair or other object. Obviously, this could be done by a belt (or belts) attached to the chair or not permanently attached to anything. However, in the preferred embodiment shown in the drawings, two nylon belts 50 and 51 are attached to the front face of the back portion 31 by stitches, not shown. The ends of the belts 50 and 51 are passed around a number of rungs 18 of the chair 20 and fastened together with buckles or, as illustrated, quick-release bayonet fasteners.

A wide belt 53 is attached to the back surface of the upper portion 31 by stitches 54. Belt 53 is formed of two layers of soft cloth (conveniently the same type of material as the body member) and has two arm portions **53*a* and 53*b* extending from opposite sides of upper portion 31. These arm portions each have a pocket for receiving a block of high density foam padding material, the pockets being closed at their outer ends by strips of material in the same manner as the pocket in seat portion 36**.

Two nylon belt portions **55*a* and 55*b* are attached to the arm portions 53*a* and 53*b* by stitches 56*a* and 56*b*, respectively, and passing through nylon belt retaining loops 57*a* and 57*b* which are attached to the arm portions by stitches, shown but not given reference numbers. The ends of the belt portions 55*a* and 55*b* are provided with male and female portions, respectively, of quick-connect and disconnect couplers, not shown but being the same as male and female portions 60 and 61 on belt 50. These enable the two belt portions 55*a* and 55*b* to be connected together so that the wide belt 53 snugly engages the body of a child. The relatively stiff foam padding together with the width of belt 53** help to prevent the upper portion of the child from falling forward and, of course, prevents the child from falling off the chair. Foam padding having a thickness of about one half inch has been found to be suitable.

In operation, arm **53*a* overlaps arm 53*b* which arms are held together by connected belt portions 55*a* and 55*b*. Although this is considered a secure means for restraining the infant, as an added measure for precaution, there may be included on the inside of arm 53*a* a sleeve 39 for insertion of arm 53*b* therein. Sleeve 39 is simply made of a piece of the same material as the fabric covering of the device having a width approximately two inches greater than that of belt 53, so as to allow easy placement of arm 53*b* through the sleeve 39 and preventing lateral movement of arm 53*b* with respect to arm 53*a*. Further, it is preferable to include a safety loop 59 consisting of nylon strapping and a slip ring. The safety loop 59 may be stitched centred to the top face of the bottom portion 36 or alternatively attached at the lower nylon belt 51 of the front face of back portion 31. The nylon strapping is passed between the infant's legs, and arm 53*a* and/or 53*b* is inserted through the loop of safety loop 59. The length of the nylon strap can be adjusted by the slip ring. Safety loop 59 is provided to prevent the child from slipping through wide belt 53** should its arms not be fastened securely enough.

While the foregoing description relates to the preferred embodiment of the invention, it will be apparent that various modifications may be made without departing from the scope of the appended claims. For example, the body member could be formed of two separate pieces of cloth instead of one folded piece and any of a variety of means could be used to fasten the ends of the belts together. The pocket in the back portion could be closed by a zipper or other fastening means instead of a VELCRO fastener. Also, the pocket openings of the back and seat portions could be located along any perimeter end thereof, such as the top end of the back portion and the bottom end of the seat portion.

The dimensions of the body member may be varied to suit children of different age groups and sizes. For a typical small child such as an infant of a few months age to a toddler of up to say, two years of age, the seat portion may be about 10 inches by $5\frac{3}{4}$ inches (25.4 cm by 14.6 cm) and the back portion about 10 inches by 13κ inches (25.4 cm by 34.3 cm). The wide arm portions **53*a* and 53*b*** may be about 9 inches by $3\frac{1}{4}$ inches (22.9 cm by 8.3 cm).

I claim:

1. A support and restraint device for a small child comprising a body member including a back portion, a seat portion and hinge means joining said back portion and said seat portion, a wide belt having first and second arm portions attached to said back portion, said arm portions being provided with means for releasably securing them together, said seat portion, said back portion and said first and second arm portions comprising cloth covered padding material, said arm portions having padding formed of blocks of solid foam material having sufficient stiffness that said arm portions, when secured together around a small child's upper body, help to hold said child in an upright seated position on said seat portion when said back portion is secured in a substantially vertical position.

2. A device as claimed in claim 1 wherein said back portion is provided with means for releasably securing said back portion to an object.

3. A device as claimed in claim 2 wherein said means for releasably securing said back portion to an object comprises at least one belt.

4. A device as claimed in claim 3 wherein said seat portion and said back portion of said body member are formed of a single rectangular piece of cloth folded longitudinally to provide a front side and a back side, said cloth being folded longitudinally about a line which is off-set from a longitudinal centre line of the cloth so that a narrow strip of cloth from the front side can be folded back over a longitudinal edge region of the back side, the two sides being sewn together at opposite ends and by a line of stitching intermediate said ends, said line of stitching dividing said body member into said back portion and said seat portion and forming said hinge means.

5. A device as claimed in claim 4 wherein said padding material of said seat portion and said back portion comprises rectangular blocks of high density foam padding material located between the front and back sides of said cloth in said back portion and said seat portion and retained therebetween by said narrow strip of cloth.

6. A device as claimed in claim 5 wherein said narrow strip of cloth in said back portion is releasably attached to said back portion by a fastener means.

7. A device as claimed in claim 6 wherein said fastener means is a hook-and-loop fastener.

8. A device as claimed in claim 6 wherein said wide belt comprises a double layer of cloth including said arm portions and an intermediate portion, said intermediate portion being secured to said back side of said back portion of said body member.

9. A device as claimed in any one of claims 1 to 8 wherein said means for releasably securing said free ends of said arm portions together comprises first and second parts of a belt secured to said arm portions, said belt parts having cooperating parts of a releasable fastener.

10. A device as claimed in claim 4 further including a safety strap having a loop formed with a slip ring, said safety strap being attached to said seat portion or a lower portion of said back portion.

11. A device as claimed in claim 5 wherein said padding material of said back portion further includes a polyethylene fluted sheet located between said block of high density foam padding material and the back side of said cloth in said back portion, said polyethylene fluted sheet having flutes running longitudinally with respect to said back portion.

12. A device as claimed in claim 8 wherein said first arm portion includes a piece of cloth sewn on the inner side thereof forming a sleeve for inserting said second arm portion.

13. A device as claimed in claim 1 wherein said padding material of said back portion is formed of blocks of solid foam.

14. A device as claimed in claim 10 wherein said padding material further includes a polyethylene fluted sheet, said polyethylene fluted sheet having flutes running longitudinally with respect to said back portion.

15. A device as claimed in claim 1 wherein said seat portion, said back portion and said first and second arm portions include openings with means for retaining said padding material therein.

16. A device as claimed in claim 1 wherein said first arm portion includes sleeve means for inserting said second arm portion therein.

17. A device as claimed in claim 1 further including a safety loop attached to said seat portion or a lower portion of said back portion for passing through the child's legs and securing to said wide belt.

* * * * *